US007554502B2

(12) United States Patent
Duan

(10) Patent No.: US 7,554,502 B2
(45) Date of Patent: Jun. 30, 2009

(54) ADJUSTING DEVICE FOR PHASE SHIFTER OF ANTENNA IN MOBILE COMMUNICATION

(75) Inventor: Hongbin Duan, Guangzhou (CN)

(73) Assignee: Comba Telecom Technology (Guangzhou) ltd., Guangzhou (CN)

( * ) Notice: Subject to any disclaimer, the term of this patent is extended or adjusted under 35 U.S.C. 154(b) by 0 days.

(21) Appl. No.: 11/916,175

(22) PCT Filed: Dec. 22, 2005

(86) PCT No.: PCT/CN2005/002283

§ 371 (c)(1),
(2), (4) Date: Mar. 18, 2008

(87) PCT Pub. No.: WO2006/128339

PCT Pub. Date: Dec. 7, 2006

(65) Prior Publication Data

US 2008/0198080 A1 Aug. 21, 2008

(30) Foreign Application Priority Data

Jun. 2, 2005 (CN) ..... 2005 2 0059283

(51) Int. Cl.
*H01Q 3/00* (2006.01)
*H01Q 1/12* (2006.01)

(52) U.S. Cl. ..... 343/757; 343/878

(58) Field of Classification Search ..... 343/793, 343/797, 810–820, 846, 757, 760, 872, 878
See application file for complete search history.

(56) References Cited

U.S. PATENT DOCUMENTS 4,129,872 A * 12/1978 Toman ..... 343/768
5,512,914 A * 4/1996 Hadzoglou et al. ..... 343/816

(Continued)

FOREIGN PATENT DOCUMENTS

JP 2003-243903 8/2003

OTHER PUBLICATIONS

International Search Report for International Application No. PCT/CN2005/002283 completed Mar. 7, 2006.

*Primary Examiner*—Shih-Chao Chen
(74) *Attorney, Agent, or Firm*—Alston & Bird LLP

(57) ABSTRACT

An adjusting device for phase shifter of antenna in mobile communication includes a gear, a rack, a screw, a driving nut, a driving shaft and a manipulating member. The gear is fixed to a rotation axis of a phase shifter on a reflecting plate of the antenna. The rack is fixed to the driving shaft. One end of the driving nut is fixed to the driving shaft. The other end of the driving nut is provided with an internal screw hole engaging with the screw. The manipulating member is jointed to the screw at one end thereof. The driving shaft and the screw are respectively supported by a driving shaft supporter and a screw supporter on the reflecting plate of the antenna. A control device is coupled to the adjusting device. The control device is formed with a rotation shaft to be suitably received in the slot in the head of the manipulating member. The present invention need not modify internal structure of the control device for different mechanical route of the phase shifter. Thus, the adjusting device according to the present invention has an approved universality and can adjust the electrical down-tilt angle more precisely.

10 Claims, 2 Drawing Sheets

U.S. PATENT DOCUMENTS 5,798,675 A 8/1998 Drach
6,078,824 A * 6/2000 Sogo ..... 455/562.1
6,188,373 B1 * 2/2001 Martek ..... 343/893
6,346,924 B1 2/2002 Heinz et al.
6,549,529 B1 * 4/2003 Drabeck et al. ..... 370/347

* cited by examiner

ADJUSTING DEVICE FOR PHASE SHIFTER OF ANTENNA IN MOBILE COMMUNICATION

BACKGROUND OF THE INVENTION

1. Field of the Invention

The present invention generally relates to adjusting devices for phase shifter of antenna and, particularly, relates to an adjusting device for phase shifter of antenna in mobile communication.

2. Description of Related Art

It is well known in the art that base station antenna in mobile communication commonly needs to be tilted downwardly with respect to the horizontal plane. Radiation effect of the base station can be improved via adjusting down-tilt angle of the antenna. At present, down-tilt angle adjustment of base station antenna can be realized via tilting the base station antenna downwardly to form a mechanical down-tilt angle in installation, or via changing phases of different radiation oscillators of the base station antenna and urging beam directions of the base station antenna to bias downwardly to form electrical down-tilt angle.

Mechanical down-tilt angle of the base station antenna may potentially induce deformation of the antenna pattern and, therefore, affect coverage area and disturb of the net. Generally, the mechanical down-tilt angle is restricted in a certain angle range. The electrical down-tilt angle is obtained via changing phases of different radiation oscillators of the antenna and urging beam directions thereof to bias downwardly. Consequently, each lobe almost has same decrease amplitude and, thus, shortcomings of the mechanical down-tilt angle are avoided. The electrical down-tilt angle is generally adjusted via a phase shifter.

As well known in the art, phase shifter is normally set in a protecting shell of the base station antenna. Control device adapted for adjusting the down-tilt angle of the base station antenna is disposed at out side of the protecting shell. Thus, a transmission device is needed to couple the control device to the phase shifter, so as to precisely transfer operating instruction of the control device to the phase shifter situated in the base station antenna and adjust the phase correspondingly.

In conventional design, a slider mechanism similar device is commonly used to actuate the phase shifter. Since the slider mechanism can not linearly transform linear displacement of the control device to angular displacement of the phase shifter, the phase of the phase shifter cannot be adjusted precisely. On the other hand, the mechanical route of the slider mechanism is introduced to the external control device and the mechanical route is controlled via an electronic switch. Therefore, internal structure of the control device needs to be modified in accordance with different mechanical route of the phase shifter, which inevitably limits versatility of the control device.

SUMMARY OF THE INVENTION

It is one object of the present invention to provide an adjusting device for phase shifter of antenna in mobile communication which can precisely adjust electrical down-tilt angle and has approved versatility.

According to one embodiment of the present invention, an adjusting device for phase shifter of antenna in mobile communication includes a gear, a rack, a screw, a driving nut, a driving shaft and a manipulating member. The gear is fixed to a rotation axis of a phase shifter on a reflecting plate of the antenna. The rack is fixed to the driving shaft. One end of the driving nut is fixed to the driving shaft. The other end of the driving nut is provided with an internal screw hole engaging with the screw. The manipulating member is jointed to the screw at one end thereof. The driving shaft and the screw are respectively supported by a driving shaft supporter and a screw supporter mounted on the reflecting plate of the antenna.

A limiter is set around the screw to prevent the manipulating member from moving axially. The other end of the manipulating member extends out of the antenna via a through-hole defined in the antenna. A jointing tube is seated in the through-hole for compliantly accommodating the manipulating member.

The screw is integrally formed with the manipulating member. Head portion of the manipulating member defines a slot for facilitating operation and control.

To facilitate operation, a control device is coupled to the adjusting device. The control device is formed with a rotation shaft to be suitably received in the slot in the head of the manipulating member. The rotation shaft is formed with a number of recesses or protrusions which can correspondingly engage with a number of protrusions or recesses disposed in inner side wall of the jointing tube to prevent the rotation shaft from rotating relative to the joining tube, which can desirably prevent the control device from disengaging from the antenna.

To advisably show the effect of adjustment, the adjusting device is equipped with an angle indicator. One end of the angle indicator is directly fixed to the driving shaft or the driving nut, or indirectly coupled to the driving shaft or the driving nut via a connecting member. The other end of the angle indicator stretches out of the protecting shell of the antenna.

Compared with conventional design, there is no need to modify the internal structure of the external control device for different mechanical route of the phase shifter. Therefore, the adjusting device in accordance with the present invention has an approved universality and can adjust the electrical down-tilt angle precisely.

Other advantages and novel features will be drawn from the following detailed description of preferred embodiments with the attached drawings, in which:

DETAILED DESCRIPTION OF THE INVENTION

Figure 1:
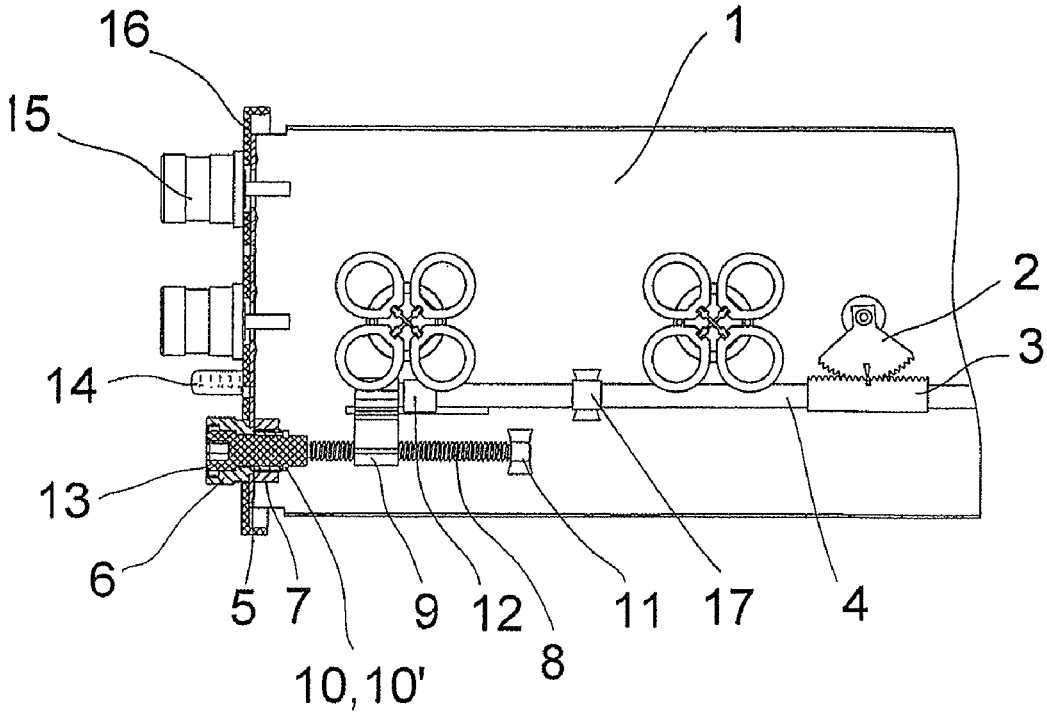
FIG. 1 depicts an exemplary, cross-sectional view of a base station antenna equipped with an adjusting device according to one embodiment of the present invention, wherein, for the sake of clarity, a control device and a portion of a protecting shell of the base station antenna have been removed.
Figure 2:
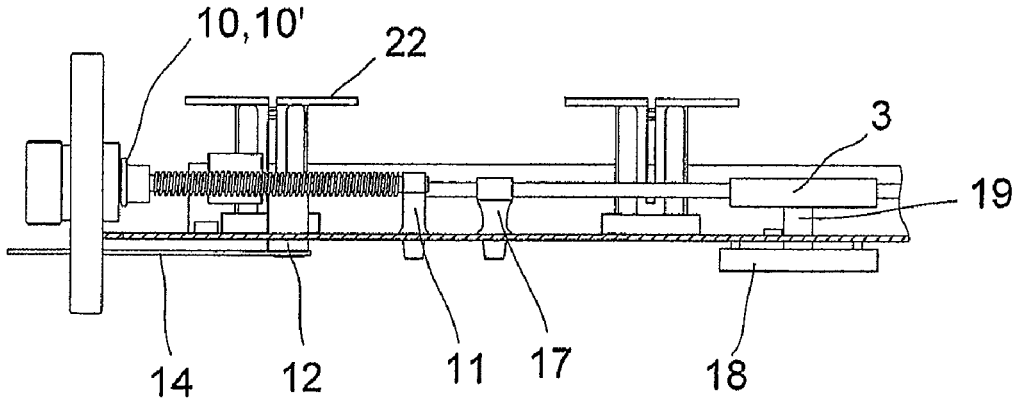
FIG. 2 depicts an exemplary bottom view of the base station antenna shown in FIG. 1.

Referring to FIGS. 1 and 2, a base station antenna in mobile communication generally includes a number of radiation oscillators 22. The radiation direction of antenna beam can be adjusted via changing feeding phases of different radiation oscillators, so as to obtain desirable electrical down-tilt angle. This can be realized via adjusting a phase shifter 18 via an adjusting device for phase shifter of antenna in mobile communication as detailed bellow.

Referring to FIGS. 1 and 2, the adjusting device for phase shifter of antenna in mobile communication includes a gear 2, a rack 3, a screw 8, a driving nut 9, a driving shaft 4, a joining tube 6 and a manipulating member 13.

The gear 2 is fixed to a rotation axis 19 of a phase shifter 18. The rack 3 is fixed on the driving shaft 4. The driving shaft 4 is supported on a driving shaft supporter 17 on a reflecting plate 1 of the antenna and can axially move along the driving shaft supporter 17. The driving shaft 4 can also be formed with a number of racks 3. The rack 3 can actuate the phase shifter 18 to work via engagement therebetween.

The phase shifter 18 and the driving shaft 4 can be mounted on rear face or front face of a reflecting plate 1. In a preferred embodiment of the present invention, the phase shifter 18 is mounted on the rear face of the reflecting plate 1. The driving shaft 4 is arranged at the front face of the reflecting plate 1.

One side of the driving nut 9 is fixed to the driving shaft 4. The other side of the driving nut 9 defines an inner thread hole which can engage with the screw 8. Due to limitation of the driving shaft 4, the driving nut 9 can not rotate but can only move along the driving shaft 4 linearly. One end of the screw 8 is fixed to the manipulating member 13. The other end of the screw 8 is sustained on a screw supporter 11 on the metal reflecting plate 1. A limiter 10 is set around the manipulating member 13 to prevent the manipulating member 13 from moving axially. Due to the restriction of the limiter 10, the manipulating member 13 can not move linearly but can only rotate. In the present embodiment, the limiter 10 is an annular clasp 10'. The other end of the manipulating member 13 stretches out of the antenna via a through-hole (not labeled) defined in the antenna. A jointing tube 6 is fixed in the through-hole via a nut 7 to compliantly receive the manipulating member 13. In the present embodiment, the through-hole is defined in a mounting panel 5 of the antenna.

To advisably show the effect of adjustment, the adjusting device is equipped with an angle indicator 14. One end of the angle indicator 14 in the protecting shell 16 is coupled to the driving shaft 4 via a connecting member 12, so as to move linearly with the driving shaft 4. The other end of the angle indicator 14 extends out of the protecting shell 16 via a hole (not labeled). The angle indicator 14 can clearly show the electrical down-tilt angle of the antenna. The angle indicator 14 can also be directly or indirectly secured to the driving nut 9 via a connecting member 12.

Alternatively, the screw 8 can also be integrally formed with the manipulating member 13.

The manipulating member 13 defines a slot (not labeled) at a head thereof adapted for facilitating operation or control. In the present embodiment, a tool can be inserted to the slot in the head and manually rotated, so as to control the manipulating member 13 and adjust the phase shifter 18.

Figure 3:
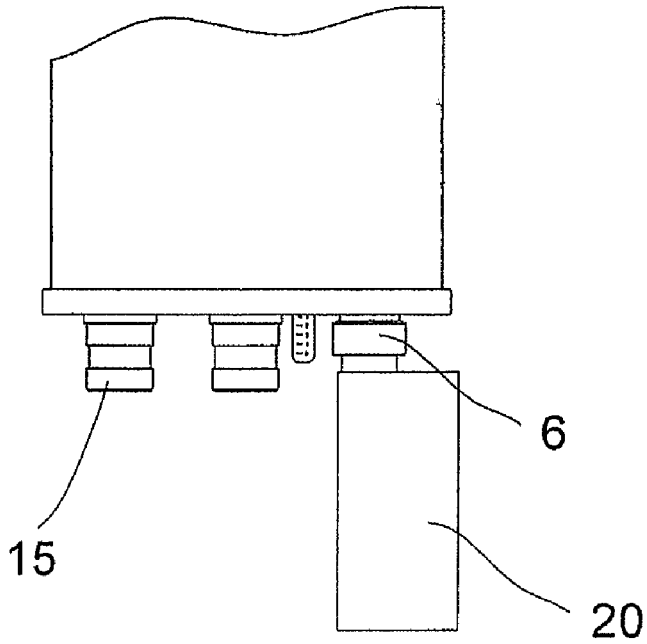
FIG. 3 depicts a part of an isometric view of a base station antenna equipped with a control device.
Figure 4:
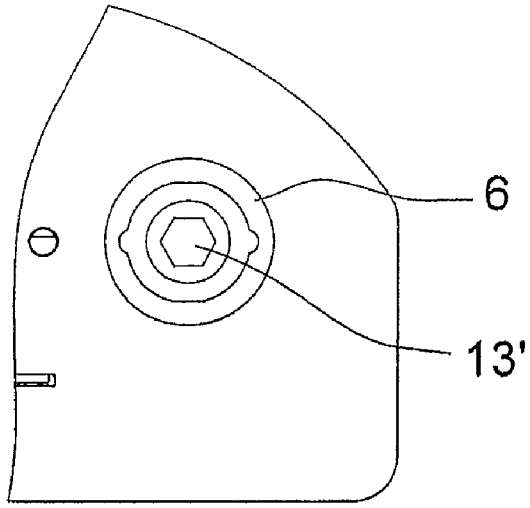
FIG. 4 depicts part of a left side view of the base station antenna as shown in FIG. 1.

Referring to FIG. 3, to facilitate operation, the joining cube 6 at a lower side of the antenna, i.e. close to the feeding electrical connector 15, is connected with an external control device 20. The control device 20 is formed with a rotation shaft (not shown) to be suitably received in the polygonal slot 13' in the head of the manipulating member 13. The rotation shaft is provided with a number of recesses or protrusions which can engage with a number of protrusions or recesses correspondingly disposed in inner side wall of the jointing tube 6, so as to prevent the rotation shaft from rotating relative to the joining tube 6, which can prevent the control device 20 from disengaging from the antenna.

In use, the control device 20 is connected to the base station equipment or other commanding equipments via cable or wireless connection. Under command, the control device 20 actuates the manipulating member 13 and the screw 8 in the antenna to rotate thereby urging the driving nut 9 coupled to the screw 8 to move linearly. The driving shaft 4 and the rack 3 fixed to the driving nut 9 then urge the gear 2 to rotate and actuate the phase shifter 18, to adjust the feeding phase of the radiation oscillator 22 of the antenna and the electrical down-tilt angle of the antenna. After the antenna is adjusted, the electrical down-tilt angle is shown on the angle indicator 14, and indicated on the base station equipment or the demanding equipment simultaneously.

The adjusting device according to one embodiment of the present invention at least has following advantages:

Firstly, the gear and the rack can precisely transform the linear displacement of the control device to the angular displacement of the phase shifter linearly and, thus, can adjust the electrical down-tilt angle more precisely.

Secondly, the screw of the adjusting device can only rotate and cannot move horizontally. The mechanical route for adjusting the phase shifter needs not to be introduced to inner side of the control device mounted on the outside of the housing of the antenna. There is no need to modify the internal structure of the external control device for different mechanical route of the phase shifter. Thus, the adjusting device according to the present invention has an approved universality.

While the present invention has been illustrated by the above description of the preferred embodiment thereof, while the preferred embodiment has been described in considerable detail, it is not intended to restrict or in any way limit the scope of the appended claims to such details. Additional advantages and modifications within the spirit and scope of the present invention will readily appear to those skilled in the art. Therefore, the present invention is not limited to the specific details and the illustrative examples shown and described.

What is claimed is:

1. An adjusting device for phase shifter of antenna in mobile communication, the adjusting device comprising:

a gear;

a rack;

a screw;

a driving nut;

a driving shaft and a manipulating member;

the gear being fixed to a rotation axis of a phase shifter on a reflecting plate of the antenna;

the rack being fixed to the driving shaft;

one end of the driving nut being fixed to the driving shaft, the other end of the driving nut being provided with an internal screw hole engaging with the screw;

the manipulating member being jointed to the screw at one end thereof; and the driving shaft and the screw being respectively supported by a driving shaft supporter and a screw supporter on the reflecting plate of the antenna.

2. The adjusting device as described in claim 1, wherein a limiter is set around the screw to prevent the manipulating member from moving axially.

3. The adjusting device as described in claim 2, wherein one end of the manipulating member stretches out of the antenna via a through-hole defined in the antenna and a jointing tube is fixed in the through-hole for compliantly receiving the manipulating member.

4. The adjusting device as described in claim 3, wherein the adjusting device is equipped with an external control device, the control device is formed with a rotation axis, head of the manipulating member is provided with an aperture for compliantly receiving the rotation axis of the control device.

5. The adjusting device as described in claim 4, wherein the control device is provided with a number of recesses or protrusions capable of correspondingly engaging with a number of protrusions or recesses disposed in inner side wall of the jointing tube.

6. The adjusting device as described in claim 1, wherein the screw is integrally formed with the manipulating member.

7. The adjusting device as described in claim 1, wherein the adjusting device is equipped with an angle indicator and one end of the angle indicator is directly fixed to or indirectly fixed to the driving shaft via a connecting member.

8. The adjusting device as described in claim 7, wherein the other end of the angle indicator extends out of a protecting shell.

9. The adjusting device as described in claim 1, wherein the adjusting device is equipped with an angle indicator and one end of the angle indicator is directly fixed to or indirectly fixed to the driving nut via a connecting member.

10. The adjusting device as described in claim 9, wherein the other end of the angle indicator extends out of a protecting shell.

* * * * *